US005965085A

United States Patent [19]

Abramin et al.

[11] Patent Number: 5,965,085

[45] Date of Patent: Oct. 12, 1999

[54] APPARATUS FOR CHARGING A SHAFT FURNACE

[75] Inventors: German Vasilievich Abramin; Andrei Vasilievich Koshelnikov, both of Novokuznetsk, Russian Federation

[73] Assignee: Zakrytoe Aktsionernoe Obschestvo Nauchno-Proizvodstvenny I Kommerchesky Tsentr "Totem", Moscow, Russian Federation

[21] Appl. No.: 09/272,118

[22] Filed: Mar. 19, 1999

[30] Foreign Application Priority Data

Mar. 20, 1998 [RU] Russian Federation ..... 98105182

[51] Int. Cl.[6] ..... C21B 7/08

[52] U.S. Cl. ..... 266/199; 266/197

[58] Field of Search ..... 266/197, 199, 266/177, 183, 184

[56] References Cited

U.S. PATENT DOCUMENTS 1,727,100 9/1929 Edwards ..... 266/199

3,549,138 12/1970 Thomas ..... 266/199

3,827,584 8/1974 Grewer et al. ..... 266/199

*Primary Examiner*—Scott Kastler

[57] ABSTRACT

An apparatus for charging a shaft furnace, in which each of plane faces of a second segment of a guiding member of a unit for distributing a burden over a cross section of the furnace is formed so that its first line of intersection with a first vertical plane passing through its geometric center and tangentially to a circle lying in a horizontal plane and having the center on an axis of the furnace and the radius equal to the distance from the furnace axis to the geometric center, is inclined at angle "α" to the horizontal plane, the intersection lines of all plane faces forming a polygonal line, each subsequent length of the polygonal line, in a burden flow direction, making a greater angle of inclination with the horizontal plane than the preceding one, and a second line of intersection of each plane face with a second vertical plane passing through its geometric center and the furnace axis is inclined at angle "β" to the horizontal plane, with angle "β" increasing with the burden flow.

3 Claims, 3 Drawing Sheets

APPARATUS FOR CHARGING A SHAFT FURNACE

FIELD OF THE INVENTION

The present invention relates to ferrous metallurgy, and more particularly, to an apparatus for charging a shaft furnace.

The invention may be most successfully used in blast furnaces.

BACKGROUND OF THE INVENTION

As of now, in the quest to intensify the iron-making process the efforts are directed to improving the blast-furnace process through optimum distribution of a gas flow over a shaft section of the blast furnace, which determines the quality of iron produced, the specific fuel consumption for its production and the blast furnace output as a whole. The uniform distribution of the gas flow over the furnace section is attained by controlling the rate of blowing and changing the layer contours of ore and coke components of the burden which is fed into a throat zone by a charging device installed on the furnace cone. Therefore, the requirements that are placed upon the charging device are to provide a desired contour of the burden layer over the furnace cross section with minimum nonuniformity in the circumferential grain-size distribution of the burden in the throat zone, and, essentially, a controlled thickness of the burden layer charged.

Conventional blast furnace charging apparatuses include a double-cone charging apparatus equipped with movable throat plates, which is disclosed in DE A 2125062.

The above apparatus for charging a shaft furnace comprises a bin having an inlet and an outlet, the bin being connected through flanges with a top portion of the furnace. The bin outlet is located in a furnace chamber, within its throat zone, and closed by a cone-shaped locking member. The locking member is adapted to move vertically. The furnace throat zone is provided with movable plates which carry distributing plates with a reflecting surface facing the bin outlet. The plates are uniformly circumferentially disposed and adapted to radially move along the guides which are rigidly fixed to the furnace shell.

In operation of the apparatus, the locking member is displaced towards the furnace chamber, and a burden is admitted through an annular gap formed to the peripheral region of the throat zone. If the blast-furnace process is disturbed, it is required to change the contour of the charged burden layer. To this end, the plates are radially displaced towards the furnace axis until they reach a position in which the path of the falling burden intersects the surface of the distributing plates, which results in altering the burden flow direction so that the burden moves towards the furnace axis. The above prior art apparatus, however, changes the contour of the burden layer charged only in the peripheral annular region due to the restricted displacement of the movable plate, which reduces the potentials of the apparatus, limiting the burden laying control only to ⅓ the furnace radius.

Most closely approaching the present invention by the combination of technical features and the achieved result is an apparatus for charging a shaft furnace, comprising a bin for a burden, the bin having an inlet and an outlet, a unit for distributing the burden over a cross section of the furnace, said unit being mounted in a throat zone beneath the bin outlet and adapted to rotate about the furnace axis. The burden distributing unit comprises a horizontal member having at least two guiding members circumferentially disposed around its periphery, each of the guiding members being connected with the horizontal member and consisting of two segments which are arranged sequentially in the direction of the burden flow. A first segment is located in the immediate vicinity to the horizontal member, and a second segment is comprised of at least two plane faces and has a burden shoot edge facing the furnace throat zone (WO Application No. 92/19776, C21B 7/20).

Owing to the design of the distributing unit, the burden body leaving the bin outlet is divided into at least two flows which form a charge layer in the throat zone with approximately even circumferential grain-size distribution. This is attained due to laying the burden pellets of the same size symmetrically about the furnace axis, thereby significantly reducing the nonuniformity of the circumferential burden weight distribution in the furnace. The uniform circumferential arrangement of the guiding members, with the first segment being disposed in the immediate vicinity to the horizontal member, makes it possible to change the radial direction of the burden flow to the circumferential one. On the guiding member second segments, the circumferential direction of the burden flow changes to the tangential one or towards the furnace axis under the effect of the resultant of frictional, centrifugal and Coriolis forces. This enables the burden to be charged to any throat region and provides the possibility to form a required stockline contour in the throat zone. This is attained by a single type of motion, in particular, by rotation of the burden distributing unit about the furnace axis. The above structural features of the charging unit provide the improvement in the blast-furnace process parameters and the reduction in energy losses. The rotary drive of the unit has a simpler structure.

In operation, a burden portion is charged from the burden bin on the horizontal member of the burden distributing unit and further along the guiding members into the furnace chamber. A burden layer is formed in the furnace throat zone by virtue of rotation of the burden distributing unit. Owing to the possibility to vary the rotational speed of said unit, the apparatus provides a desired stockline contour in the shaft furnace. This improves the blast-furnace process characteristics. However, a required stockline contour is not provided when laying the burden by the above apparatus in the region adjacent to the furnace axis, since the non-optimal spatial orientation of the plane faces of the guiding member second segment hinders the admission of a sufficient amount of material into the furnace axial region. As a consequence, the optimum gas distribution over the furnace cross section is not provided, resulting in the increased coke consumption and some reduction in the output. In addition, in the prior art apparatus the position of plane faces of the guiding members fails to be unambiguously defined which makes the manufacture of the apparatus as such problematic, and further hampers the attainment of a desired stockline contour in the furnace throat zone.

SUMMARY OF THE INVENTION

It is an object of the present invention to provide an apparatus for charging a shaft furnace, having a unit for distributing a burden over the furnace cross section designed so that to provide a required stockline contour in the furnace throat zone with a highly uniform circumferential grain-size and weight distribution of the burden.

The foregoing and other objects of the present invention are achieved in an apparatus for charging a shaft furnace, comprising a bin for a burden, the bin having an inlet and an outlet and being connected with a unit for distributing the burden over a cross section of the furnace, the unit being adapted to be mounted in a throat zone and rotate about an axis of the furnace axis beneath the bin outlet along a burden flow which is formed by a horizontal member having at least two uniformly circumferentially disposed guiding members, each of the guiding members being connected to the horizontal member and including two segments which are arranged sequentially in a burden flow direction, a first of the segments being disposed in the immediate vicinity to the horizontal member, while a second segment is defined by at least two plane faces and has a burden shoot edge which faces the furnace throat zone, wherein in accordance with the invention each of the plane faces of the second segment is formed so that its first line of intersection with a first vertical plane passing through its geometric centre and tangentially to a circle lying in a horizontal plane and having the centre on the furnace axis and the radius equal to the distance from the furnace axis to the geometric centre is inclined at angle "α" to the horizontal plane, the intersection lines of all plane faces (25, 25*a*, 25*b*) forming a polygonal line, each sequential length of which in the burden flow direction has greater inclination angle "α" than the preceding one, and a second line of intersection of each plane face with a second vertical plane passing through its geometric centre and the furnace axis is inclined at angle "β" to a horizontal plane, with angle "β" increasing with the burden flow.

The increase in inclination angle "α" of the plane faces in the burden flow direction provides the reduction in bonding forces between each subsequent plane face and the burden flow, promoting the burden descent from the guiding members. As a consequence, the material falls closer to the furnace axial region at a minimum rotational speed of the unit, providing the charging of the middle region of the throat zone.

The design of the guiding member with plane faces of the second segment simultaneously changing angles "β" of inclination towards the furnace axis, changes the burden flow direction towards the furnace axis at low rotational speeds of the unit, providing the charging of the throat zone centre.

The above design of the burden distributing unit allows the attainment of a required stockline contour by varying the rotational speed of the unit. This enables the peripheral region of the throat zone to be charged at a maximum rotational speed, the axial region to be charged at a minimum rotational speed and the middle region to be charged at intermediate values of the unit rotational speed. With the rotational speed of the distributing unit being unchanged, the burden will be laid in the throat zone in the form of an annular ridge with a distinct apex. When the rotational speed of the distributing unit is varied during the discharge from high to low, the burden is laid in the throat zone in a spiral, so that a layer with a smoothened surface is formed.

Preferably the first segment of each guiding member comprises a trough with side walls having a height which is equal to ½ the segment width at the beginning of the segment and ⅕ the segment width at the end thereof.

The trough-like configuration of the first segment results in forming a burden flow entering the second segment as a directed jet, which ensures the provision of a required weight ratio of coke and ore components in the vertical stock column over the entire furnace volume.

Preferably a bottom of the first segment trough at the connection with the surface of the second segment is deeper than the latter. This deepening amounts to 20 to 60 mm which is about one-half an average diameter of burden particles charged into the shaft surface. Consequently, the lower plane of the guiding member trough portion will be lined with small charge fractions and have an optimally rough surface on which the burden flow will be formed.

Owing to such configuration of the first segment, the trough bottom surface is afforded the protection against abrasive wear due to forming a burden layer on the first segment surface, which extends the life of the burden distributing unit. Moreover, the burden flow motion over the burden layer formed on the first segment of the guiding member results in a blended grain-size distribution of the burden charged into the throat zone of the furnace. With the unit being rotated, the above circumstance ensures that the burden layer formed in the above region has a minimum nonuniformity in the circumferential burden grain-size distribution in the furnace throat zone.

BRIEF DESCRIPTION OF THE DRAWINGS

These and other objects and advantages of the invention will be best appreciated from the following detailed description of a preferred embodiment, taken in conjunction with the accompanying drawings in which.

DESCRIPTION OF THE PREFERRED EMBODIMENTS

Figure 1:
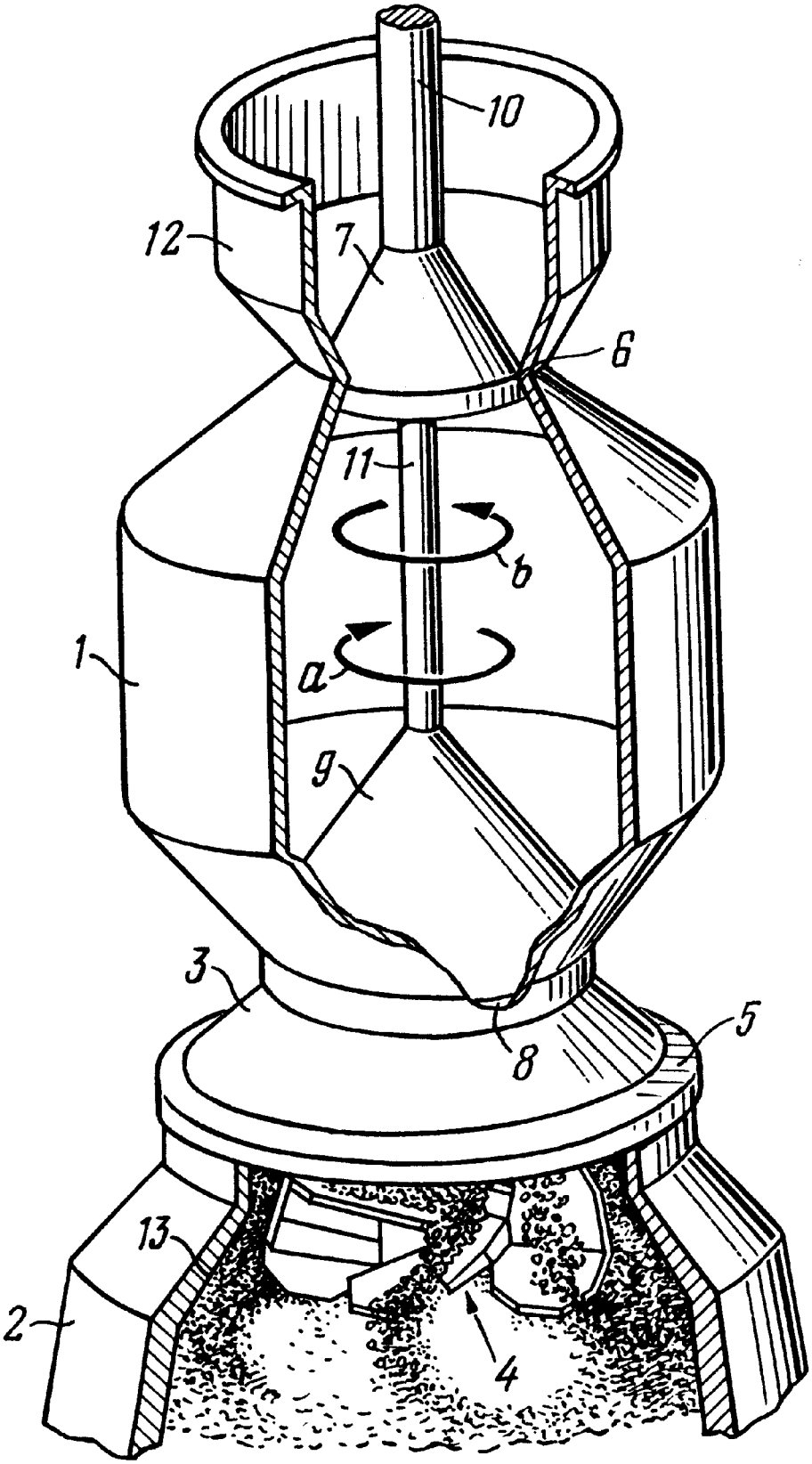
FIG. 1 is a schematic perspective view of an apparatus for charging a shaft furnace, with a partial cutout.

An apparatus for charging a shaft furnace, such as a blast furnace, in accordance with the invention includes a burden bin 1 (FIG. 1) connected with a furnace 2 via a casing 3 which is coaxial with the bin 1 and the furnace 2. The casing 3 accommodates a rotary drive of a unit 4 for distributing burden over a cross section of the furnace 2 and has a ring 5 for connection with the latter. The bin 1 has a burden inlet 6 closed by a cone-shaped locking member 7 and an outlet 8 closed by a cone-shaped locking member 9. The inlet 6 and the outlet 8 are concentric with the axis of symmetry of the bin 1. The cone-shaped locking members 7 and 9 are connected to vertical displacement drives (not shown in FIG. 1) via bars 10 and 11, respectively. Burden is charged into the bin 1 through a hopper 12 which is mounted on the bin 1 and serves to accumulate a burden portion which is loaded, for instance, by a conveyor (not shown in FIG. 1). The unit 4 is connected with the top portion of the furnace 2 and disposed in its chamber within a throat zone 13 beneath the outlet 8 of the bin 1. The geometric axis of rotation of the unit 4 is coaxial with the outlet 8 which communicates with the casing 3 cavity connected with the throat zone 13 of the furnace 2. The unit 4 (FIG. 2) comprises a horizontal member 14 in the form of a hub 15 which serves to divide the burden axial flow into radial flows and has an opening 15*a* for mounting on a shaft (not shown). The hub is defined by a polyhedron having, for instance, five uniformly circumferentially disposed guiding members 16 around its periphery. Each of the members 16 is comprised of a first segment 17 and a second segment 18 which are disposed sequentially in the burden flow direction. The first segment 17 of each of the guiding members 16 serves to change the radial burden flow to the circumferential one, while the second segment 18 deflects the circumferential direction, depending on the rotational speed and direction of the unit 4. Rigidity of the unit 4 is increased by stiffening ribs 19, 20, for instance, in the trapezium form. In order to reduce the weight of the unit 4, the hub 15 is provided with blind holes 21. The first segment 17 of the guiding member 16 is made in the form of a trough with walls 22, while the second segment 18 is comprised of, for instance, three plane faces 25, 25*a* and 25*b* and has a burden shoot edge 24. The trough bottom of the first segment 17 is 20 to 60 mm deeper than the plane faces 25, 25*a*, 25*b* of the second segment 18, i.e. a step is formed in the connection region between the first segment 17 and the second segment 18. A height of the trough walls 22 decreases with the burden flow, making up ½ the segment width at beginning of the first segment 17 and ⅕ the segment width at the end thereof. Each guiding member 16, being a part of the unit 4, makes an angle with a horizontal plane so that its burden shoot edge 24 faces the throat zone 13 of the furnace 2 (FIG. 1), and the vectors of circumferential velocity components of the burden motion over all guiding members 16 have the same direction. Inclination angles "α" of the plane faces 25, 25*a* and 26*b* of the second segment 18 increase with the burden flow so as to meet inequality $\alpha_{25}<\alpha_{25a}<\alpha_{25b}$. To this end, the plane face 25 of the second segment 18 is made so that its first line $m_{25}$ of intersection with a first vertical plane passing through geometric centre $O_{25}$ of this plane face and tangentially to a circle lying in a horizontal plane and having the centre on axis A—A of the furnace 2 and the radius equal to the distance from the furnace axis to geometric centre $O_{25}$ is inclined at angle $\alpha_{25}$ to the horizontal plane. First line $m_{25a}$ of intersection of the plane face 25*a* with a first vertical plane passing through its geometric centre $O_{25a}$ and tangentially to a circle lying in a horizontal plane and having the centre on axis A—A of the furnace 2 and the radius equal to the distance of the furnace axis to geometric centre $O_{25a}$ is inclined at angle $\alpha_{25a}$ to the horizontal plane, with $\alpha_{25a}>\alpha_{25}$.

Figure 4:
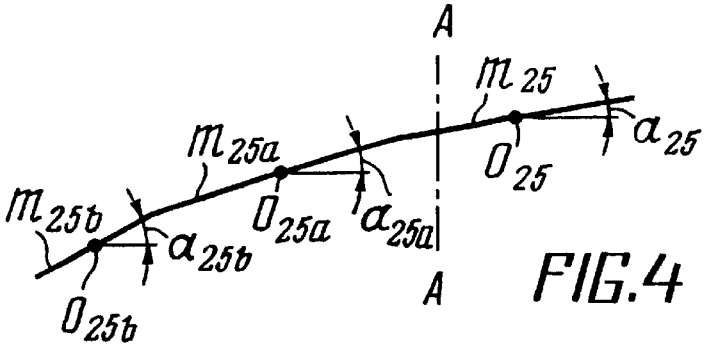
FIG. 4 is a view developed through section IV—IV of FIG. 3 formed by first vertical planes.

The plane face 25*b* is made in a similar manner, in particular, its first line $m_{25b}$ of intersection with a first vertical plane passing through its geometric centre $O_{25b}$ and tangentially to a circle lying in a horizontal plane and having the centre on axis A—A of the furnace 2 and the radius equal to the distance from the furnace axis to geometric centre $O_{25b}$ is inclined at angle $\alpha_{25b}$ to the horizontal plane, with $\alpha_{25b}>\alpha_{25a}$. Consequently, the first lines of intersection of all plane faces 25, 25*a* and 25*b* form a polygonal line (FIG. 4), each subsequent length of which has a greater inclination angle than the preceding one, i.e. the inclination angles increase with the burden flow so as to meet inequality $\alpha_{25}<\alpha_{25a}<\alpha_{25b}$.

Figure 5:
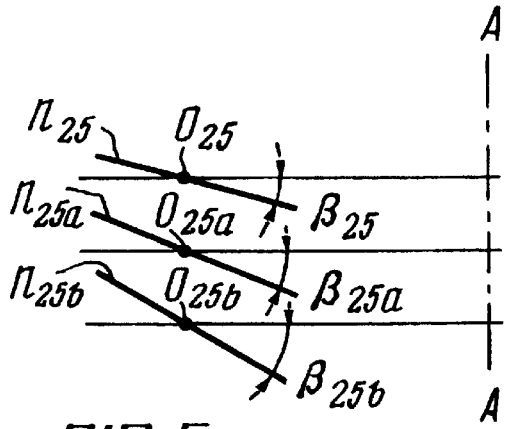
FIG. 5 is a view developed through section V—V of FIG. 3 formed by second vertical planes.

The limit of the variation in the inclination angle of the plane faces 25, 25*a* and 25*b* is defined experimentally. The plane faces 25, 25*a* and 25*b* are also inclined to axis A—A of the furnace 2, making angles "β" with a horizontal plane. For this purpose the plane face 25 of the second segment 18 is made so that its second line $n_{25}$ (FIG. 5) of intersection with a second vertical plane passing through geometric centre $O_{25}$ and axis A—A of the furnace 2 is inclined at angle $\beta_{25}$ to a horizontal plane. Second line $n_{25a}$ of intersection of the plane face 25*a* with a second vertical plane passing through geometric centre $O_{25a}$ and axis A—A of the furnace 2 is inclined at angle $\beta_{25a}$ to a horizontal plane, with $\beta_{25a}>\beta_{25}$. The plane face 25*b* is made in a similar manner, in particular, its second line $n_{25b}$ of intersection with a second vertical plane passing through geometric centre $O_{25b}$ and axis A—A of the furnace 2 is inclined at angle $\beta_{25b}$ to a horizontal plane, with $\beta_{25a}>\beta_{25a}$. Therefore, each subsequent line of intersection of the plane face, in the burden flow direction, is inclined at greater angle β so as to meet inequality $\beta_{25}<\beta_{25a}<\beta_{25b}$. The limit of the change in angle β is also determined experimentally.

Figure 2:
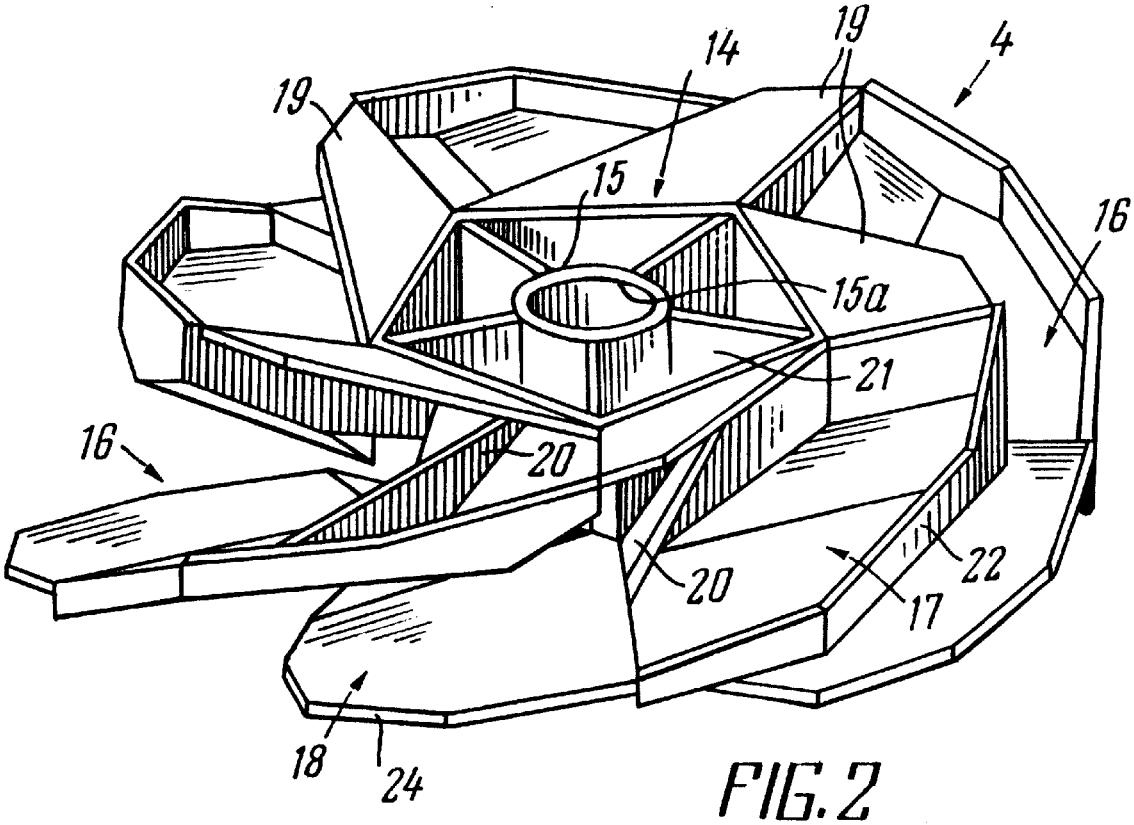
FIG. 2 is an enlarged perspective view of a unit for distributing burden over the furnace cross section, in accordance with the present invention.
Figure 3:
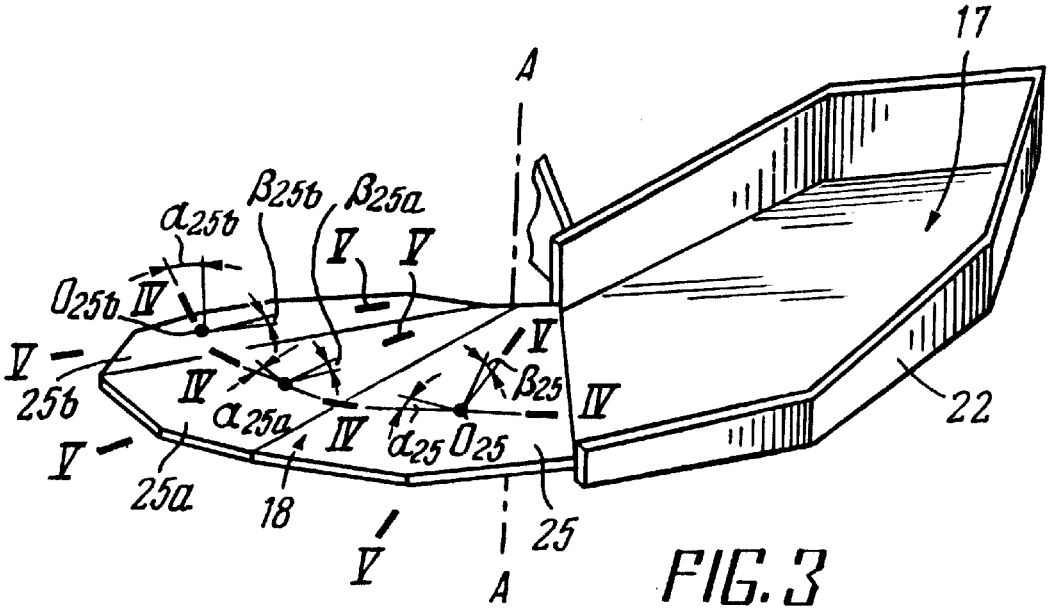
FIG. 3 is a perspective view of a guiding member.
Figure 6:
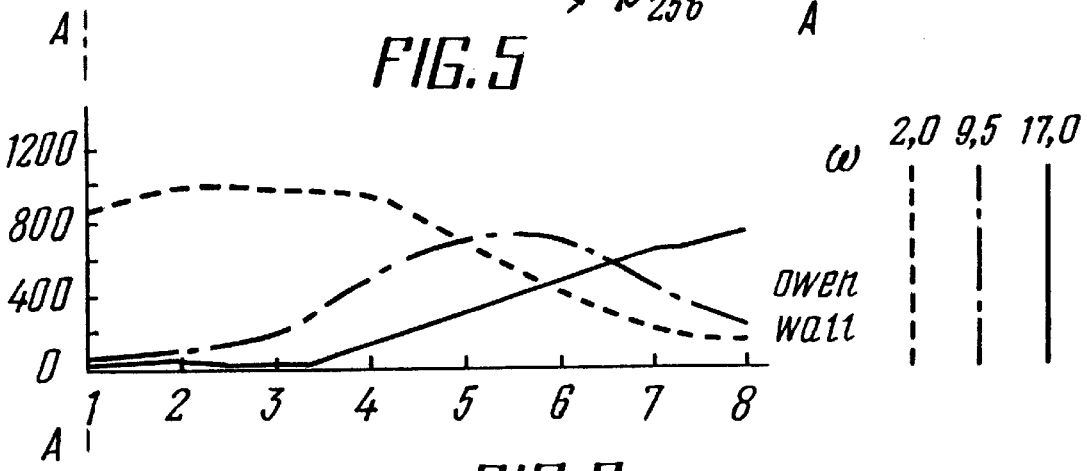
FIG. 6 is a stockline contour in the furnace throat zone at a forward rotation direction of the charging unit.
Figure 7:
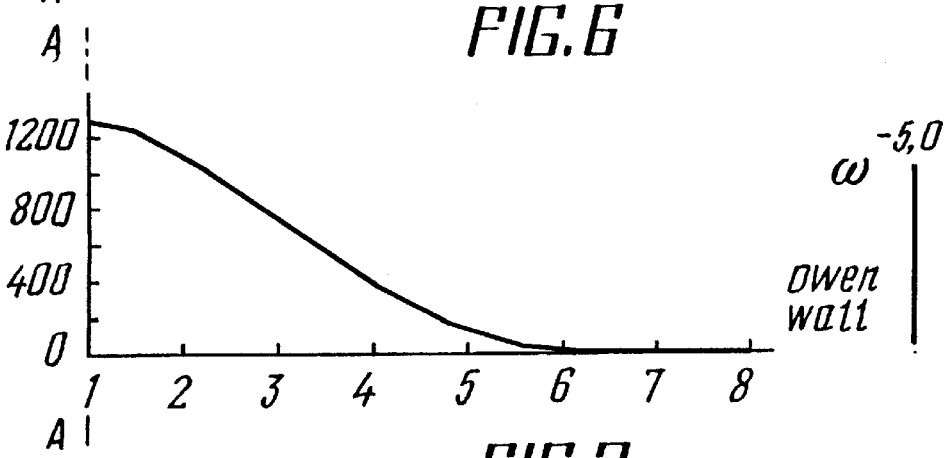
FIG. 7 is a stockline contour in the furnace throat zone at a reverse rotation direction of the charging unit.

An apparatus for charging a shaft furnace operates in the following manner. The inlet 6 of the bin 1 is closed by a cone-shaped locking member 7 (FIG. 1), and the hopper 12 is filled by a burden portion supplied thereto by a conveyor (not shown). Further, a drive (not shown) displaces, via the bar 10, the cone-shaped locking member 7, the latter descends and opens the inlet 6, and the burden is admitted through an annular gap into the bin 1. Here, the burden grain-size composition and weight are distributed over the cross section of the bin 1 by any conventional method, the burden being accumulated since the cone-shaped member 9 closes the outlet 8. Once the hopper 12 has been emptied, the cone-shaped member 7 is displaced by a drive (not shown) via the bar 10 upwards to close the inlet 6. It is a common knowledge that in performing the blast-furnace process at increased gas pressure in the throat zone of the furnace 2, prior to discharging a burden portion from the bin 1 into the furnace 2 the gas pressure is equalized between the cavities of the bin 1 and furnace 2 using any conventional technique. After that a drive (not shown) displaces, via the bar 11, the cone-shaped locking member 9 downwards to form an annular gap through which the burden is admitted into the casing 3 cavity and further to holes 21 in the hub 15. Once the blind holes 21 have been filled with the burden, the latter forms on the surface of the hub 15 a pyramidal surface, the edges of which divide the burden into separate flows which are shot to the troughs of the guiding members 16 along the faces of the burden pyramidal surface. A charge layer is accumulating in each trough until the layer surface is even with the plane face 25. Then, the burden flow direction on the burden layer surface in the trough changes from radial to circumferential. Generated in the trough is a jet flow of the burden which is actively stirred due to its motion over the burden layer surface, resulting in a blended grain-size distribution of the burden. The premature shooting of the burden from the trough is prevented by the trough side walls having a height of ½ the segment width at the beginning of the first segment 17, and ⅕ the segment width at the end thereof. The above relationships have been found experimentally in order to provide an optimum cross section of the charge flow formed. From every trough of the first segment 17, the burden flow passes to the second segment 18 of the guiding member 16, where, with the unit 4 rotating in the direction shown by arrow "a" (FIG. 1), the burden flows change their direction under the action of the resultant of the frictional, centrifugal and Coriolis forces. When the direction of the unit 4 rotation is the same as the direction of the burden flow over the guiding member 16 and the rotational speed of the unit 4 is, for example, 2 r.p.m., the burden moves along the dotted path (FIG. 6), providing the charging of the middle portion of the throat zone 13. As the rotational speed of the unit 4 increases to 9.5 r.p.m., the burden flow changes its initial direction, and the burden drop path, shown by the dash-dot line, displaces from the furnace middle region to its periphery. At a maximum rotational speed of the unit 4, for example, 17 r.p.m., the throat zone is charged at its periphery, in particular, the burden is laid immediately against the furnace 2 wall, as shown by the solid line in FIG. 6. The axial region of the furnace 2 is charged when the unit 4 increases the speed and reverses the direction of rotation, as shown by arrow "b" (FIG. 1). When the rotational speed of the unit 4 reaches, for instance, 5 r.p.m., the burden is charged directly to the furnace centre, as shown by the solid line in FIG. 7. Thus, a required contour of the burden charged into the throat zone 13 of the furnace 2 is provided by changing the rotation direction and speed of the unit 4, with a minimum nonuniformity in the circumferential grain-size and weight distribution of the burden in the furnace 2. To compensate disturbances in the blast-furnace process, caused by a circumferentially asymmetric gas flow distribution in the furnace 2, the nonuniformity of the burden grain-size and weight distribution in the annular flow received at the unit 4 is increased in agreement with the gas flow asymmetry by any conventional method.

When the unit 4 rotates in the direction of arrow "a" (FIG. 1) which is coincident with the burden flow over the guiding member 16, at the rotational speed of the unit 4 close to a minimum one, as the burden travels from the surface 25 to the surface 25*a*, and from the surface 25*a* to the surface 25*b*, the frictional force between the burden and the surfaces 25, 25*a*, 25*b* decreases, provided inequality $\alpha_{25}<\alpha_{25a}<\alpha_{25b}$ is met, with the velocity of the burden descent from the final surface 25*b* being increased. The foregoing results in changing the initial conditions of the burden free fall from the guiding member 16, under which the burden flight range reduces, providing the charging of the furnace middle region which is located closer to its axis. Furthermore, the axial region of the furnace is charged at the rotational speed less than a maximum one.

To enhance the efficiency of forming a required stockline contour of the charge closer to the central region of the furnace, elements of the plane faces 25, 25*a* and 25*b* of the second segment 18 are further inclined to axis A—A of the furnace 2. If the inclination angle of line $n_{25}$ of intersection of the plane face 25 with a second vertical plane is less than $\beta_{25}$, only the peripheral region 13 of the furnace 2 is charged due to the considerably increased action of the centrifugal force on the burden, which inhibits the burden from charging the axial region. With the inclination angle of line $n_{25b}$ of intersection of the plane face 25*b* with a second vertical plane being greater than $\beta_{25b}$, only the axial region of the furnace 2 is charged due to an increase in the gravity component acting on the burden and directed along the slope line of the second portion 18 to the furnace axial region, as compared to the resultant of the centrifugal, frictional and Coriolis forces.

The mechanism of the effect of the plane face inclinations to the furnace axis is as follows: When the burden distributing unit 4 rotates in the direction of arrow "a" which is coincident with the direction of the burden motion over the guiding member 16, and the rotational speed of the unit 4 is close to a minimum one, as the burden travels from the surface 25 to the surface 25*a* and further from the surface 25*a* to the surface 25*b*, the frictional force between the burden and the surfaces 25, 25*a* and 25*b* decreases, provided inequality $\beta_{25}<\beta_{25a}<\beta_{25b}$ is met, and the burden flow changes its circumferential direction to the radial one, i.e. towards the furnace axis. Thus, the axial region of the furnace is charged. When the rotational speed of the unit 4 is 2 r.p.m., the centre of the furnace throat zone is charged. With the rotational speed of the unit 4 being increased, the throat zone is charged in the direction from the furnace axis to its periphery, and at a maximum rotational speed of the unit 4 of 17 r.p.m., the peripheral region of the furnace is charged, in particular, the burden flow falls immediately against its wall. Thus, in the light of the foregoing, it will be appreciated that owing to the design of the guiding member 16, the burden can be charged over the entire surface of the throat zone, from the furnace axis to its periphery, with the unit 4 rotating in the same direction. This provides the possibility to obtain a required stockline contour in the throat zone 13 from a single portion of the burden, ensuring the elimination of disturbances in the blast-furnace process in a short time interval.

An apparatus for charging a shaft furnace in accordance with the invention, when installed at a blast furnace with a working volume of, for example, 2000 cu m, provides a high-quality circumferential distribution of every burden portion over the entire surface of the throat zone in a short time, such as 20, . . . 30 s, thereby increasing the furnace output up to 20% and enhancing the cost efficiency due the coke consumption reduced by 15%.

We claim:

1. An improvement relating to an apparatus for charging a shaft furnace in combination with the shaft furnace, including:

a bin for a burden;

an inlet in said bin;

an outlet in said bin;

a shaft furnace;

a throat zone in said shaft furnace;

a unit for distributing the burden over a cross section of said furnace, said unit being adapted to be disposed in said throat zone and rotate about an axis of said furnace beneath said outlet in said bin along a flow of the burden, and connected to said bin;

a horizontal member of said unit;

at least two guiding members of said unit, said guiding members being uniformly circumferentially disposed around a periphery of said horizontal member, each of said at least two guiding members being connected with said horizontal member and having two segments, a first segment and a second segment, which are arranged sequentially in a burden flow direction, the first of said two segments being located in the immediate vicinity of said horizontal member;

at least two plane faces forming the second segment of said two segments, wherein when intersecting each plane face of said at least two plane faces with a first vertical plane passing through the geometric centre of the plane face and tangentially to a circle lying in a horizontal plane and having the centre on the axis of said furnace and the radius equal to the distance from the axis of said furnace to the geometric centre, an intersection line is formed which is inclined at angle "α" to the horizontal plane, the intersection lines of said at least two plane faces forming a polygonal line, each of successive lengths of which, in the burden flow direction, makes a greater angle of inclination with the horizontal plane than the preceding one, when intersecting each plane face of said at least two plane faces with a second vertical plane passing through the geometric centre of said plane face and the axis of the furnace, an intersection line is formed which is inclined at angle "β" to the horizontal plane, with angle "β" increasing with the burden flow;

a burden shoot edge of said second segment, said burden shoot edge facing said throat zone of said furnace.

2. The improvement as set forth in claim 1, wherein said first segment of each of said at least two guiding members comprises a trough including:

a bottom of said trough;

side walls of said trough, a height of said walls decreasing with the burden flow, wherein said height of said walls is equal to ½ the width of said first segment at the beginning and ⅕ the width of said segment at the end thereof.

3. The improvement as set forth in claim 2, wherein said bottom of said trough of said first segment is deeper than said second segment by an amount equal to one-half a size of particles of the burden charged.

* * * * *